US008360031B2

(12) United States Patent
Lee

(10) Patent No.: US 8,360,031 B2
(45) Date of Patent: Jan. 29, 2013

(54) VARIABLE COMPRESSION RATIO DEVICE

(75) Inventor: Eun Ho Lee, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 409 days.

(21) Appl. No.: 12/834,426

(22) Filed: Jul. 12, 2010

(65) Prior Publication Data

US 2011/0079200 A1 Apr. 7, 2011

(30) Foreign Application Priority Data

Oct. 6, 2009 (KR) ..... 10-2009-0094824

(51) Int. Cl.
*F02B 75/04* (2006.01)

(52) U.S. Cl. ..... 123/483; 123/78 BA

(58) Field of Classification Search ..... 123/48 R, 123/48 B, 78 R, 78 B, 78 BA
See application file for complete search history.

(56) References Cited

U.S. PATENT DOCUMENTS 5,417,185 A * 5/1995 Beattie ..... 123/48 B

* cited by examiner

*Primary Examiner* — Noah Kamen
(74) *Attorney, Agent, or Firm* — Morgan, Lewis & Bockius LLP

(57) ABSTRACT

A variable compression ratio device having a piston, a crankshaft, a connecting rod including a small end portion connected to the piston, may include a piston pin fixed to the connecting rod and fixed thereto, a receiving hole formed inside the piston and rotatably receiving the piston pin, wherein the receiving hole includes a convex portion and a concave portion, at least a variable pin slidably coupled to the piston pin and slidably coupled to the interior circumference of the receiving hole, wherein the at least a variable pin has a protrusion, and an oil supply passage selectively supplying oil to apply hydraulic pressure to the at least a variable pin, wherein the protrusion of the at least a variable pin is selectively coupled to the convex portion or the concave portion of the receiving hole.

18 Claims, 3 Drawing Sheets

VARIABLE COMPRESSION RATIO DEVICE

CROSS-REFERENCE TO RELATED APPLICATION

The present application claims priority to Korean Patent Application No. 10-2009-0094824 filed on Oct. 6, 2009, the entire contents of which is incorporated herein for all purposes by this reference.

BACKGROUND OF THE INVENTION

1. Field of the Invention

The present invention relates to a variable compression ratio device, and more particularly to a variable compression ratio device that is capable of changing a compression ratio of a mixture in a combustion chamber corresponding to driving conditions of an engine.

2. Description of Related Art

Generally, thermal efficiency of combustion engines increases as the compression ratio thereof increases, and if ignition timing is advanced to some degree, thermal efficiency of spark-ignition engines increases.

However, if the ignition timing of the spark-ignition engines is advanced at a high compression ratio, abnormal combustion may occur and the engine may be damaged. Thus, the ignition timing cannot be advanced a large amount and accordingly engine output may deteriorate.

A variable compression ratio (VCR) apparatus changes the compression ratio of an air-fuel mixture according to a driving state of an engine.

The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

A conventional variable compression ratio apparatus can achieve a predetermined compression ratio of the air-fuel mixture according to a driving state of the engine, but it cannot achieve different strokes corresponding to intake/compression/expansion/exhaust strokes, respectively.

Particularly, if the expansion stroke is longer than that of the compression stroke, thermal efficiency may further improve. However, it is difficult to achieve a longer expansion stroke than compression stroke according to the conventional variable compression ratio apparatus.

In addition, a high compression ratio/low exhaust amount at a low load condition and a low compression ratio/high exhaust amount at a high load condition may be preferable in order to achieve low fuel consumption and high power output.

Herein, since oil pressure or an electric motor etc. must be provided as an actuator in order to change the compression ratio, a pump size is increased and electrical load is increased due to a large capacity electric motor.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio device having advantages of reducing the number of parts because of not using oil pressure or an electric motor for rotating an eccentric bearing.

In an aspect of the present invention, the variable compression ratio device having a piston, a crankshaft, a connecting rod including a small end portion rotatably connected to the piston and a large end portion rotatably connected to the crankshaft and converting reciprocative motion of the piston to rotary motion of the crankshaft, may include a piston pin that passes through the small end portion of the connecting rod and fixed thereto, a receiving hole formed inside the piston and rotatably receiving the piston pin therein, wherein the receiving hole includes a convex portion and a concave portion along an interior circumference thereof, at least a variable pin slidably coupled to an exterior circumference of the piston pin and slidably coupled to the interior circumference of the receiving hole, wherein the at least a variable pin has a protrusion at an exterior circumference thereof, and an oil supply passage selectively supplying oil to apply hydraulic pressure to the at least a variable pin so as to slidably move the at least a variable pin along the piston pin, wherein the protrusion of the at least a variable pin is selectively coupled to the convex portion or the concave portion of the receiving hole to change a distance between an upper surface of the piston and a center axis of the piston pin.

The concave and convex portions of the receiving hole may be formed in the piston by turns so as to be symmetrical with respect to the small end portion, and wherein the at least a variable pin constitutes a pair and are controlled so as to be moved closer to or farther from each other by the hydraulic pressure supplied from the oil supply passage.

The pair of variable pins are slidably coupled to both end portions of the piston pin and controlled to be moved closer to or farther from each other by the hydraulic pressure supplied from the oil supply passage.

The device may further include a flange protruding outwardly from respective variable pin and hydraulic pressure of the oil supply passage is selectively applied to one side of the flange to move the respective variable pin, and an elastic member supporting the other side of the flange, wherein the elastic member exerts an elastic force on the other side of the flange so as to move the pair of variable pins closer to each other when the hydraulic pressure of the oil supply passage is released.

The device may further include a sliding pin that is slidably coupled to the small end portion of the connecting rod and selectively moved by the hydraulic pressure of the oil supply passage to pressurize the one side of the flange to move the respective valve pin, wherein the oil supply passage is disposed inside the connecting rod and supplies the hydraulic pressure to an end of the sliding pin to move the respective variable pin.

The protrusion of the at least a variable pin may include an upper protrusion that is formed at an upper portion of the exterior circumference of the at least a variable pin so as to protrude eccentric upwardly from a central axis of the at least a variable pin, and a lower protrusion that is disposed at a lower portion of the exterior circumference of the at least a variable pin so as to protrude eccentric downwardly from the central axis of the at least a variable pin, wherein the upper protrusion and the lower protrusion are alternatively formed along a longitudinal axis of the at least a variable pin.

The convex portion may include an upper convex portion and an upper concave portion formed in sequence in an upper inner circumference of the receiving hole, and a lower convex portion and a lower concave portion formed in sequence in a lower inner circumference of the receiving hole, wherein the upper protrusion is selectively engaged with the upper convex or concave portion and the lower protrusion is selectively engaged with the lower concave or convex portion.

A horizontal thickness of the upper projection may be smaller than a horizontal thickness of the upper concave portion and a horizontal thickness of the lower projection is smaller than a horizontal thickness of the lower concave portion.

The upper and lower concave portions may be integrally formed with a circular shaped groove and the upper and lower convex portions are integrally formed with a circular shape between the upper and lower concave portions.

The upper protrusion may be engaged with the upper convex portion and the lower protrusion is engaged with the lower concave portion when the hydraulic pressure is released from the oil supply passage to decrease a distance between the upper surface of the piston and the center axis of the piston pin, and wherein the upper protrusion is engaged with the upper concave portion and the lower protrusion is engaged with the lower convex portion when the hydraulic pressure is applied to the at least a variable pin to increase a distance between the upper surface of the piston and the center axis of the piston pin.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
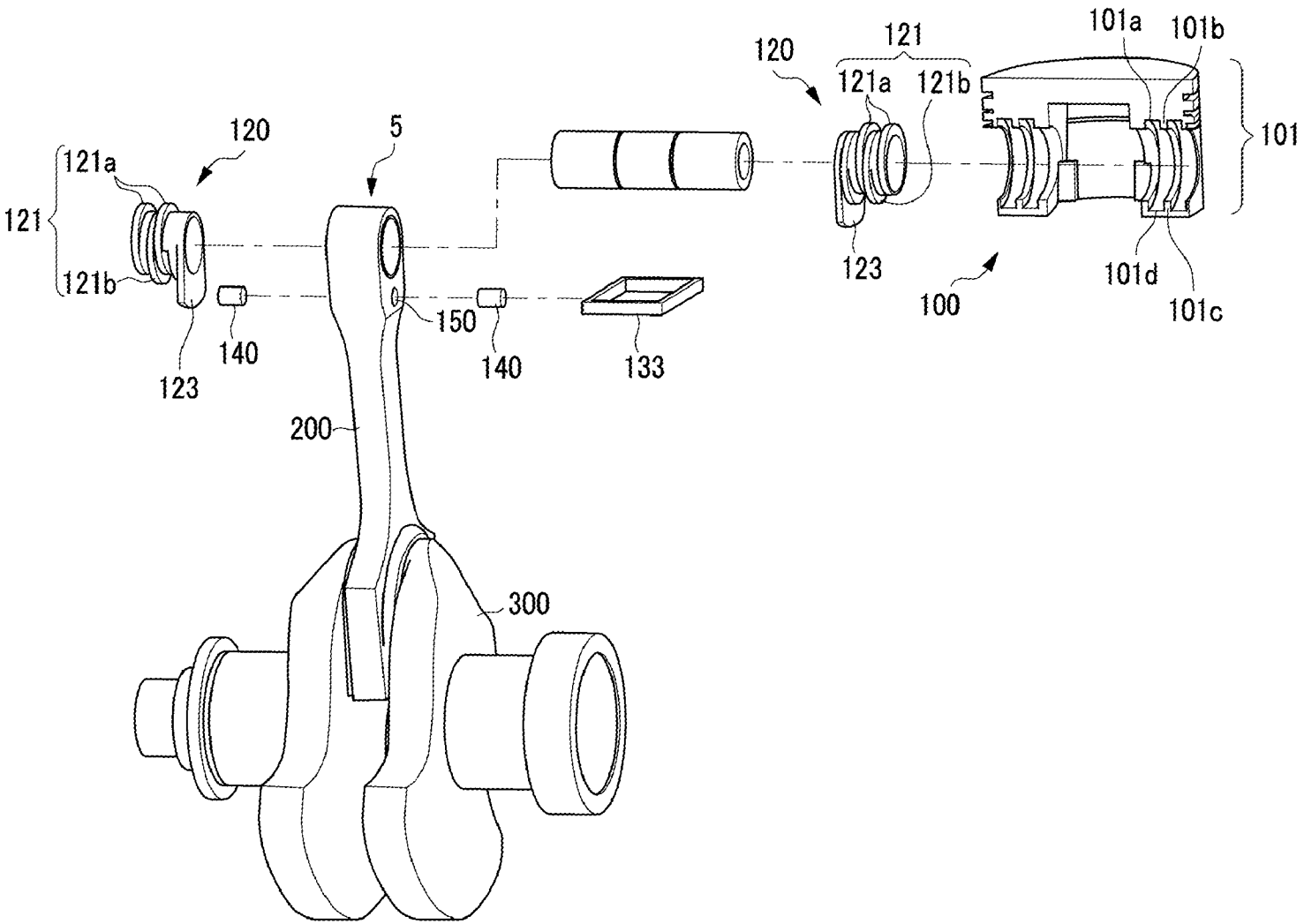
FIG. 1 is an exploded view of an exemplary variable compression ratio apparatus according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is an exploded view of a variable compression ratio device according to an exemplary embodiment of the present invention.

Figure 2:
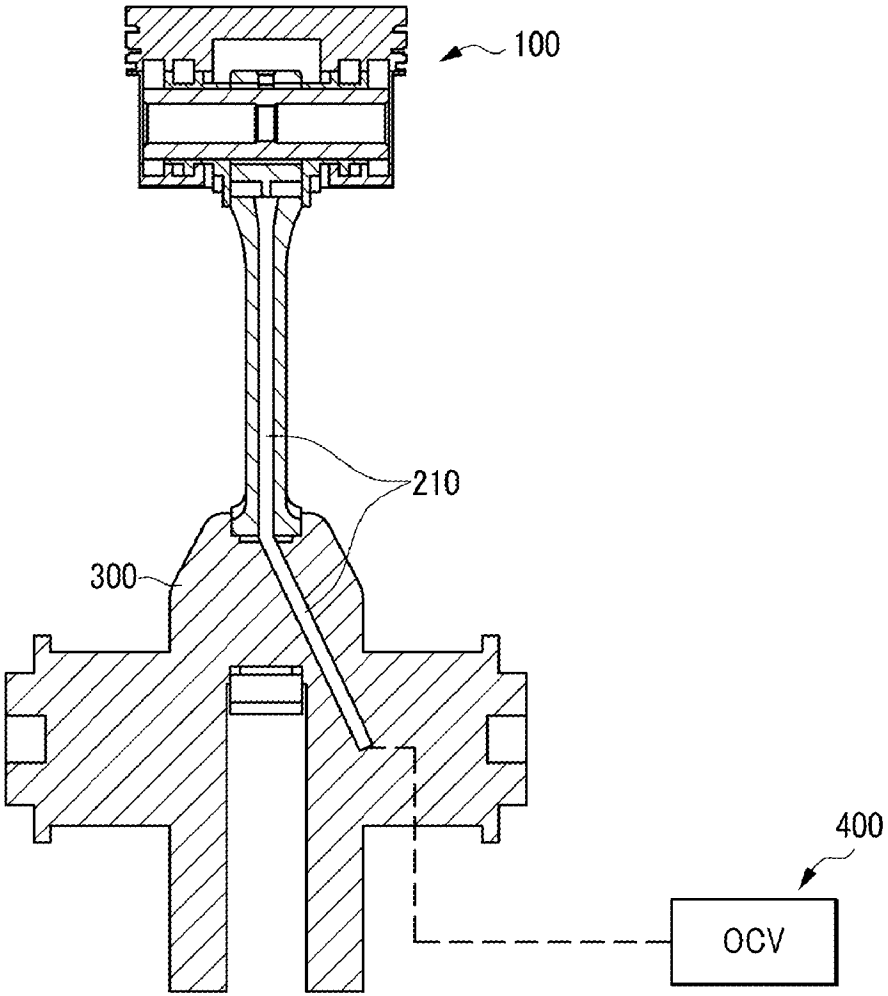
FIG. 2 is a cross-sectional view of an exemplary variable compression ratio apparatus according to the present invention.

FIG. 2 is a cross-sectional view of a variable compression ratio device according to an exemplary embodiment of the present invention.

Figure 3:
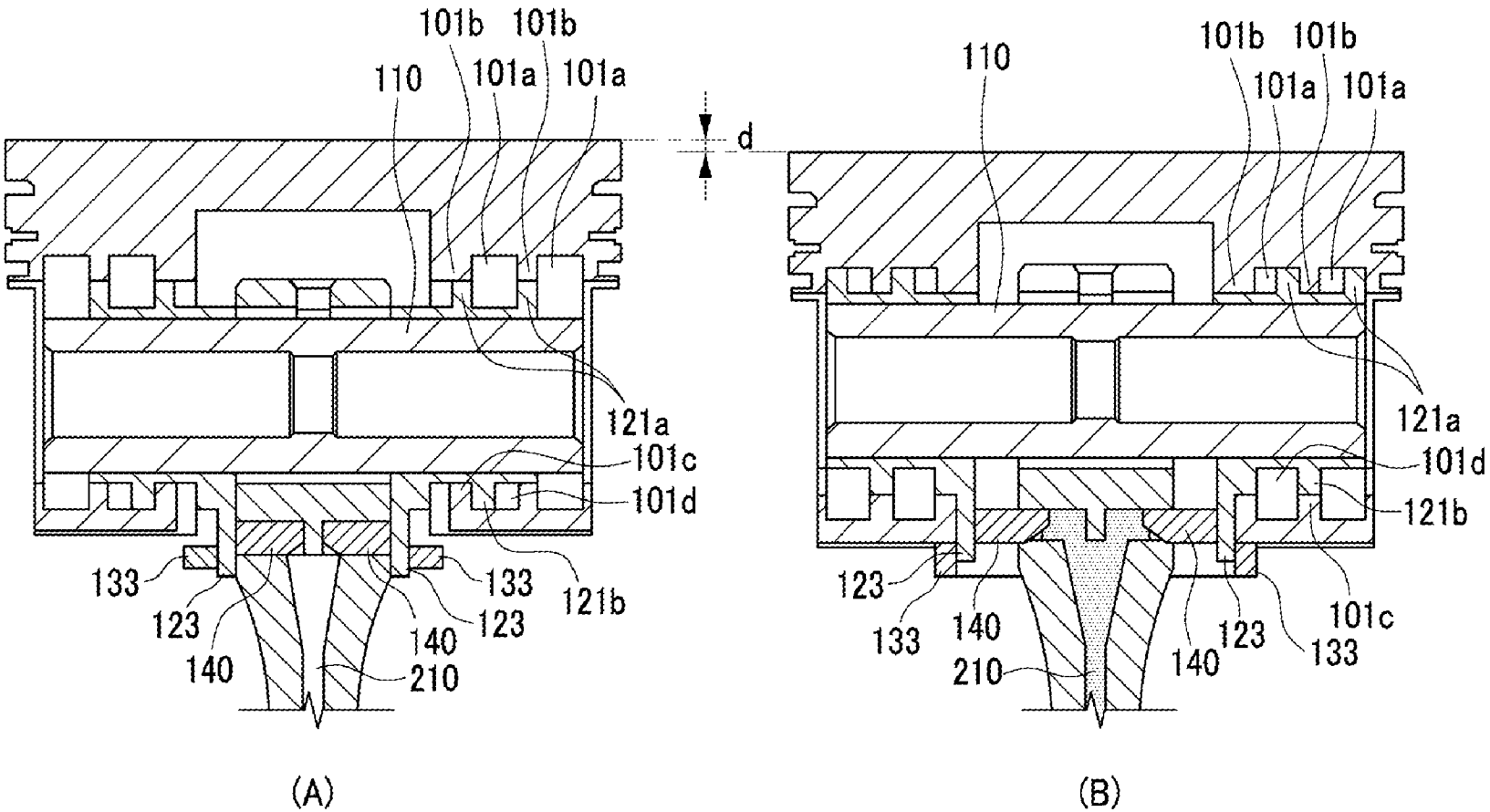
FIG. 3 shows an operating state of an exemplary variable compression ratio apparatus according to the present invention.

FIG. 3 shows an operating state of a variable compression ratio device according to an exemplary embodiment of the present invention.

Referring to FIG. 1, a variable compression ratio device according to an exemplary embodiment of the present invention includes a piston 100 reciprocally moving inside a cylinder (not shown), a crankshaft 300 converting reciprocative motion of the piston 100 to rotary motion through a connecting rod 200 connected to the piston 100, a piston pin 110 fixedly inserted in a small end portion 5 of the connecting rod 200, and a variable pin 120 mounted around the piston pin 110.

The piston pin 110 penetrates the inside of the piston 100, and simultaneously the variable pin 120 is mounted around the piston pin 110.

Further, a protrusion 121 is formed at an exterior circumference of the variable pin 120, and receiving hole 101 is formed at an interior circumference of the piston 100 so as to correspond to the protrusion 121.

Herein, the protrusion 121 includes an upper protrusion 121*a* and a lower protrusion 121*b* that are each eccentric.

The upper protrusion 121*a* is eccentric upwardly from a central axis of the variable pin 120, and the lower protrusion 121*b* is eccentric downwardly from a central axis of the variable pin 120.

Further, the variable pin 120 is slidably mounted at an exterior circumference of the piston pin 110 in an axial direction thereof, and the protrusion 121 is selectively engaged with concave portion 101*a* and 101*d* or convex portion 101*b* and 101*c* of the receiving hole 101.

Therefore, the protrusion 121 is formed as an upper protrusion 121*a* and a lower protrusion 121*b*, and the receiving hole 101 includes the upper concave portion 101*a* and an upper convex portion 101*b*, the lower convex portion 101*c* and a lower concave portion 101*d*, engaging or disengaging with the protrusion 121.

Herein, a plurality of the upper concave portions 101*a* and the lower concave portion 101*d* are integrally formed at an interior circumference of the piston 100 as circular-shaped grooves, and the upper convex portion 101*b* and the lower convex portion 101*c* are integrally formed at an interior circumference of the piston 100 as circular-shape between the concave portions 101*a* and 101*d*.

The upper protrusion 121*a* is formed so as to be selectively engaged or disengaged with the upper concave portion 101*a*, and in this way, the lower protrusion 121*b* is formed so as to be selectively engaged or disengaged with the lower concave portion 101*d*.

As shown in (A) of FIG. 3, when the lower protrusion 121*b* is engaged with the lower concave portion 101*d*, the height of the piston 100 is increased.

At this time, the upper protrusion 121*a* upwardly supports the upper convex portion 101*b*.

On the contrary, when the upper protrusion 121*a* is engaged with the upper concave portion 101*a*, the height of the piston 100 is decreased.

The lower protrusion 121*b* also downwardly supports the lower convex portion 101*d*.

Thus, as the variable pin 101 is slid, the upper protrusion 121*a* of the variable pin 101 or the lower protrusion 121*b* are selectively engaged with the upper concave portion 101*a* and lower concave portion 101*d* of the receiving hole 101, so the height of the piston 100 is increased or decreased.

Further, flanges 123 are vertically formed at a surface facing each other between the variable pins 120.

Herein, an elastic member 133 is formed such that both sides of the flanges 123 are moved closer to each other.

Thus, the elastic member 133 is formed as rectangular-shaped frame so as to inwardly exert a force on the flanges 123.

Further, a pin hole 150 is formed at both surfaces of the small end portion 5 of the connecting rod 200.

Sliding pins 140 are respectively inserted into both sides of the pin hole 150.

Further, as shown in FIG. 2, an oil supply passage 210 is formed inside the small end portion 5 of the connecting rod 200 so as to communicate with the pin hole 150.

Herein, an oil control valve 400 may be provided to supply oil to the oil supply passage 210.

When the oil is supplied to the oil supply passage 210 by the oil control valve 400, the sliding pins 140 are moved outwardly.

Hereinafter, an operation of the variable compression ratio device according to an exemplary embodiment of the present invention will be described.

As shown in FIG. 3, the flange 123 is pushed inwardly by the elastic force of the elastic member 133 when oil is not supplied from the oil control valve 400, and the upper protrusion 121*a* upwardly supports the upper convex portion 101*b*.

Therefore, the height of the piston 100 is maintained by the support of the protrusion 121, wherein a distance between the upper surface of the piston 100 and a center axis of the piston pin 100 is increased.

That is, a high compression ratio for the compressed air is realized by the increase of the height of the piston 100.

Meanwhile, as shown in (B) of FIG. 3, when oil is supplied to the oil supply passage 210 of the connecting rod 200 by the oil control valve 400, the sliding pins 140 are moved farther from each other.

At this time, the sliding pin 140 supports an interior surface of each variable pin 120, and then move the variable pins 120 outwardly against an elastic force of the elastic member 133 encompassing the variable pin 120.

The variable pins 120 slide along an exterior circumference of the piston pin 110 so as to be farther from each other.

At this time, the upper protrusion 121*a* of the variable pin 120 is set into the upper concave portion 101*a*, and the height of the variable pin 120 is changed as the height of the piston 100 is decreased as a distance of the upper protrusion 121*a* engaged with the upper concave portion 101*a* changes such that a distance between the upper surface of the piston 100 and a center axis of the piston pin 100 is decreased.

Thus, the height of the piston 100 is changed as the height of the piston pin 110 is disposed to be coaxial with the variable pin 120.

Therefore, by changing the height of the piston 100, the compression ratio of the cylinder is changed.

As can been seen from the forgoing, the variable compression ratio device according to an exemplary embodiment of the present invention has advantages of reducing the number of parts because of not using oil pressure or an electric motor for rotating an eccentric bearing.

Further, because only design of a connecting rod and a piston is needed, and not for a crankshaft, the design is simplified and web inertia of the crankshaft is minimized.

For convenience in explanation and accurate definition in the appended claims, the terms "upper", "lower", "interior", "exterior", "inner," and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio device having a piston, a crankshaft, a connecting rod including a small end portion rotatably connected to the piston and a large end portion rotatably connected to the crankshaft and converting reciprocative motion of the piston to rotary motion of the crankshaft, comprising:

a piston pin that passes through the small end portion of the connecting rod and fixed thereto;

a receiving hole formed inside the piston and rotatably receiving the piston pin therein, wherein the receiving hole includes a convex portion and a concave portion along an interior circumference thereof;

at least a variable pin slidably coupled to an exterior circumference of the piston pin and slidably coupled to the interior circumference of the receiving hole, wherein the at least a variable pin has a protrusion at an exterior circumference thereof; and an oil supply passage selectively supplying oil to apply hydraulic pressure to the at least a variable pin so as to slidably move the at least a variable pin along the piston pin, wherein the protrusion of the at least a variable pin is selectively coupled to the convex portion or the concave portion of the receiving hole to change a distance between an upper surface of the piston and a center axis of the piston pin.

2. The device of claim 1, wherein the concave and convex portions of the receiving hole are formed in the piston by turns so as to be symmetrical with respect to the small end portion, and wherein the at least a variable pin constitutes a pair and are controlled so as to be moved closer to or farther from each other by the hydraulic pressure supplied from the oil supply passage.

3. The device of claim 2, wherein the pair of variable pins are slidably coupled to both end portions of the piston pin and controlled to be moved closer to or farther from each other by the hydraulic pressure supplied from the oil supply passage.

4. The device of claim 3, further comprising:

a flange protruding outwardly from respective variable pin and hydraulic pressure of the oil supply passage is selectively applied to one side of the flange to move the respective variable pin; and an elastic member supporting the other side of the flange, wherein the elastic member exerts an elastic force on the other side of the flange so as to move the pair of variable pins closer to each other when the hydraulic pressure of the oil supply passage is released.

5. The device of claim 4, further comprising a sliding pin that is slidably coupled to the small end portion of the connecting rod and selectively moved by the hydraulic pressure of the oil supply passage to pressurize the one side of the flange to move the respective valve pin.

6. The device of claim 5, wherein the oil supply passage is disposed inside the connecting rod and supplies the hydraulic pressure to an end of the sliding pin to move the respective variable pin.

7. The device of claim 1, wherein the protrusion of the at least a variable pin includes:

an upper protrusion that is formed at an upper portion of the exterior circumference of the at least a variable pin so as to protrude eccentric upwardly from a central axis of the at least a variable pin; and a lower protrusion that is disposed at a lower portion of the exterior circumference of the at least a variable pin so as to protrude eccentric downwardly from the central axis of the at least a variable pin.

8. The device of claim 7, wherein the upper protrusion and the lower protrusion are alternatively formed along a longitudinal axis of the at least a variable pin.

9. The device of claim 7, wherein the convex portion includes:

an upper convex portion and an upper concave portion formed in sequence in an upper inner circumference of the receiving hole; and a lower convex portion and a lower concave portion formed in sequence in a lower inner circumference of the receiving hole, wherein the upper protrusion is selectively engaged with the upper convex or concave portion and the lower protrusion is selectively engaged with the lower concave or convex portion.

10. The device of claim 9, wherein a horizontal thickness of the upper projection is smaller than a horizontal thickness of the upper concave portion and a horizontal thickness of the lower projection is smaller than a horizontal thickness of the lower concave portion.

11. The device of claim 9, wherein the upper and lower concave portions are integrally formed with a circular shaped groove and the upper and lower convex portions are integrally formed with a circular shape between the integrated upper and lower concave portions.

12. The device of claim 9, wherein the upper protrusion is engaged with the upper convex portion and the lower protrusion is engaged with the lower concave portion when the hydraulic pressure is released from the oil supply passage to decrease a distance between the upper surface of the piston and the center axis of the piston pin, and wherein the upper protrusion is engaged with the upper concave portion and the lower protrusion is engaged with the lower convex portion when the hydraulic pressure is applied to the at least a variable pin to increase a distance between the upper surface of the piston and the center axis of the piston pin.

13. The device of claim 1, further comprising:

a flange protruding outwardly from the at least a variable pin and the hydraulic pressure of the oil supply passage is selectively applied to one side of the flange to move the at least a variable pin; and an elastic member supporting the other side of the flange, wherein the elastic member exerts an elastic force on the other side of the flange so as to move the at least a variable pin closer to the small end portion of the connecting rod when the hydraulic pressure of the oil supply passage is released.

14. The device of claim 13, further comprising a sliding pin that is slidably coupled to the small end portion of the connecting rod and selectively moved by the hydraulic pressure of the oil supply passage to pressurize the one side of the flange to move the at least a valve pin.

15. The device of claim 13, wherein the oil supply passage is disposed inside the connecting rod and supplies the hydraulic pressure to an end of the sliding pin to move the at least a variable pin.

16. The device of claim 15, further comprising a separate oil control valve so as to control oil supply of the oil supply passage.

17. A variable compression ratio device having a piston, a crankshaft, a connecting rod including a small end portion rotatably connected to the piston and a large end portion rotatably connected to the crankshaft and converting reciprocative motion of the piston to rotary motion of the crankshaft, comprising:

a piston pin that passes through the small end portion of the connecting rod and is fixed thereto;

upper concave and convex portions and lower concave and convex portions formed inside the piston by turns so as to be symmetrical with respect to the small end portion;

at least a variable pin that has an exterior circumference corresponding to the upper concave and convex portions and lower concave and convex portions, and is slidably coupled to an exterior circumference of the piston pin;

an elastic member elastically supporting a flange integrally protruding outwardly from a radial direction of the at least a variable pin;

an oil supply passage selectively pressurizing the flange against elastic force of the elastic member; and a sliding pin that is slidably coupled in the small end portion of the connecting rod and moved by a hydraulic pressure of the oil supply passage to pressurize a side of the flange in one direction, wherein the height of an upper surface of the piston is changed according to engagement or disengagement between an upper protrusion of the at least a variable pin and the upper concave or convex portion of the piston and between a lower protrusion of the at least a variable pin and the lower concave or convex portion of the piston.

18. The device of claim 17, wherein the upper protrusion is engaged with the upper convex portion and the lower protrusion is engaged with the lower concave portion such that the height of the piston is increased when one variable pin is moved closer to the other variable pin, and the upper protrusion is engaged with the upper concave portion and the lower protrusion is engaged with the lower convex portion such that the height of the piston is decreased when one variable pin is moved farther from the other variable pin.

* * * * *